United States Patent [19]

Kicks et al.

[11] Patent Number: 4,927,162

[45] Date of Patent: May 22, 1990

[54] DARTBOARDS

[76] Inventors: Henry W. Kicks, 22 Orchard Close; Malcolm Kicks, The Daubers, Keddington Road, both of Haverhill, Suffolk, England

[21] Appl. No.: 274,921

[22] Filed: Nov. 22, 1988

Related U.S. Application Data

[63] Continuation of Ser. No. 63,133, filed as PCT GB86/00569 on Sep. 23, 1986, published as WO87/01796 on Mar. 26, 1987, abandoned.

[30] Foreign Application Priority Data

Sep. 23, 1985 [GB] United Kingdom ..... 8523446
Apr. 24, 1986 [GB] United Kingdom ..... 8610011

[51] Int. Cl.[5] ..... F41J 3/00
[52] U.S. Cl. ..... 273/408
[58] Field of Search ..... 273/408

[56] References Cited

U.S. PATENT DOCUMENTS 4,328,971 5/1982 Stone et al. ..... 273/408

FOREIGN PATENT DOCUMENTS

| | | | |
|---|---|---|---|
| 2361133 | 3/1978 | France | 273/408 |
| 406400 | 3/1934 | United Kingdom | 273/408 |
| 525369 | 8/1940 | United Kingdom | 273/408 |
| 981483 | 1/1965 | United Kingdom | 273/408 |
| 2026879 | 2/1980 | United Kingdom | 273/408 |
| 2069854 | 9/1981 | United Kingdom | 273/408 |
| 2103497 | 2/1983 | United Kingdom | 273/408 |

*Primary Examiner*—Paul E. Shapiro
*Attorney, Agent, or Firm*—Nutter, McClennen & Fish

[57] ABSTRACT

A dartboard of compressed sisal fibers having beds defined by radial and circular wires, the radial and at least part of the circular bed-defining wires being of quadrilateral cross-section with one of the corners in contact with the sisal fibers so that the opposite corner is exposed to oncoming darts, wherein the radial wires are notched at positions where they intersect the circular wires of quadrilateral cross-section whereby to form emplacements for the circular wires of quadrilateral cross-section.

5 Claims, 2 Drawing Sheets

Fig. 2.
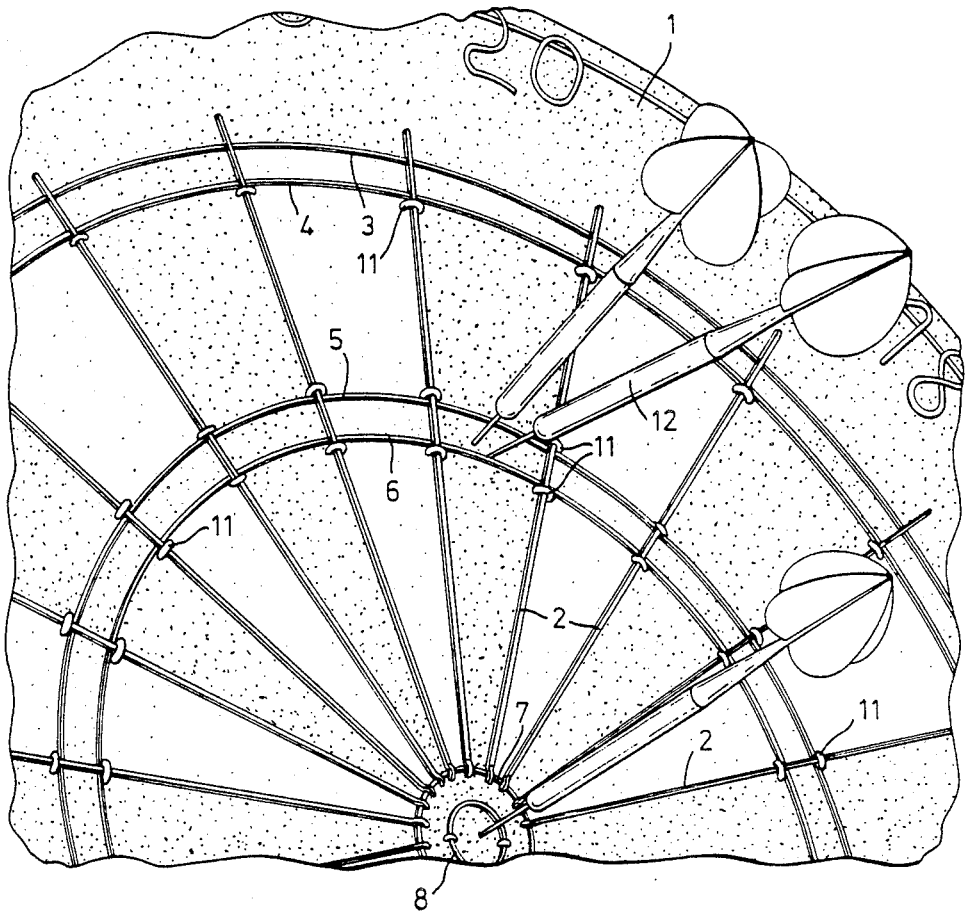
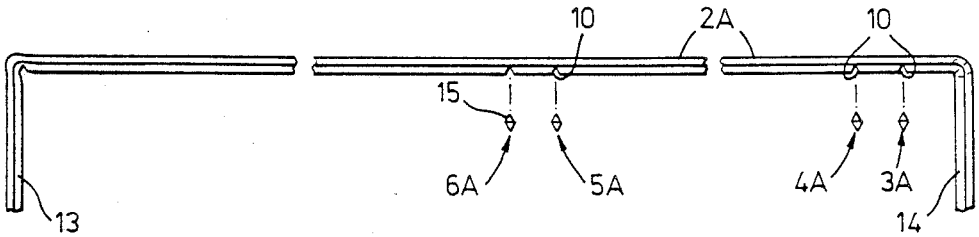
Fig. 3.

DARTBOARDS

This application is a continuation of application Ser. No. 07/063,133 filed as PCT GB86/00569 on Sep. 23, 1986, published as WO87/01796 on Mar. 26, 1987, abandoned.

The invention relates to dartboards.

Quality dartboards are nowadays made from what is commonly termed bristles but consist of compressed sisal fibers. They used to be constructed from wood such as elm but sisal boards are more economical and take a dart better and with less damage. The playing or scoring area of the board are known as beds and are delineated by radial and circular wires stapled to the sisal. The wires define a center circle (inner bull) around which there is an annulus (outer bull). From the outer bull, twenty equal sectors extend to a wire circle which is disposed near the periphery of the board and, together with another circle of wire defines a doubles ring. A similar ring known as the trebles ring is midway between the doubles ring and the outer bull and defined by a further circle of wire. Numbers identifying the scoring values of the twenty segments are usually also bent from wire and stapled to the board beyond the beds.

Conventionally, all the wire is made from round stock because this is the cheapest. However, as dart players will know, the dart points often strike the wire, hit the sisal board material very obliquely and "bounce off" to fall on the floor. This is annoying, especially in match play, but accepted as unavoidable with bristle boards. In the past, when good boards still had to be made of wood such as elm, it was suggested that the problem might be overcome with wire of square or diamond cross-section. This is described in GB-PS 406400 from which it will be known that the wood has to be recessed so that half the cross-section of the wire is embedded in the wood. This is costly and in any case not applicable to bristle boards. On the other hand, non-circular wires fixed on top of bristle boards tend to twist to a position where an even wider surface is presented to oncoming darts and the problem of bouncing off becomes very much aggravated.

The invention aims to improve the dartboard construction so that bouncing off is minimizing with bristle boards.

In an embodiment of the invention to be described, a dartboard of compressed sisal fibers has beds defined by radial and circular wires, the radial and at least part of the circular bed-defining wires are of quadrilateral cross-section, preferably square or rhomboidal, with one of the corners in contact with the sisal fibers so that the opposite corner is exposed to oncoming darts, and the radial wires are notched at positions where they intersect the circular wires of quadrilateral cross-section to form emplacements for the said circular wires of quadrilateral cross-section. The radial wires may be weled to the circular wires of quadrilateral cross-section at the intersections.

It has been found that, with this construction and arrangement, the wires will not twist and dart points will almost always glide along the exposed sides of the wire to become embedded in the board as is desired.

It was at one time suggested that dartboard wire could be made of triangular cross-section (GB-PS 406400) but this has proved unsuccessful because, for adequate strength, the triangle sides of the soft wire had to be made comparatively large, thereby giving the darts even more opportunity to bounce off. By means of the invention, however, the cross-sectional size of the wire can be small without sacrificing strength and preliminary tests have shown that the darts practically never bounce off the wires. Indeed, surprisingly, not once has it so far been possible to make the darts bounce off intentionally by throwing them when standing up close to the board and deliberately hitting the wires.

An example of the invention will now be described with reference to the accompanying drawings, wherein:

FIG. 2 is an enlarged fragmentary perspective view thereof, and

FIG. 3 is an exploded side elevation of a radial wire and four co-operating circumferential wires shown in cross-section for a dartboard embodying the invention.

Figure 1:
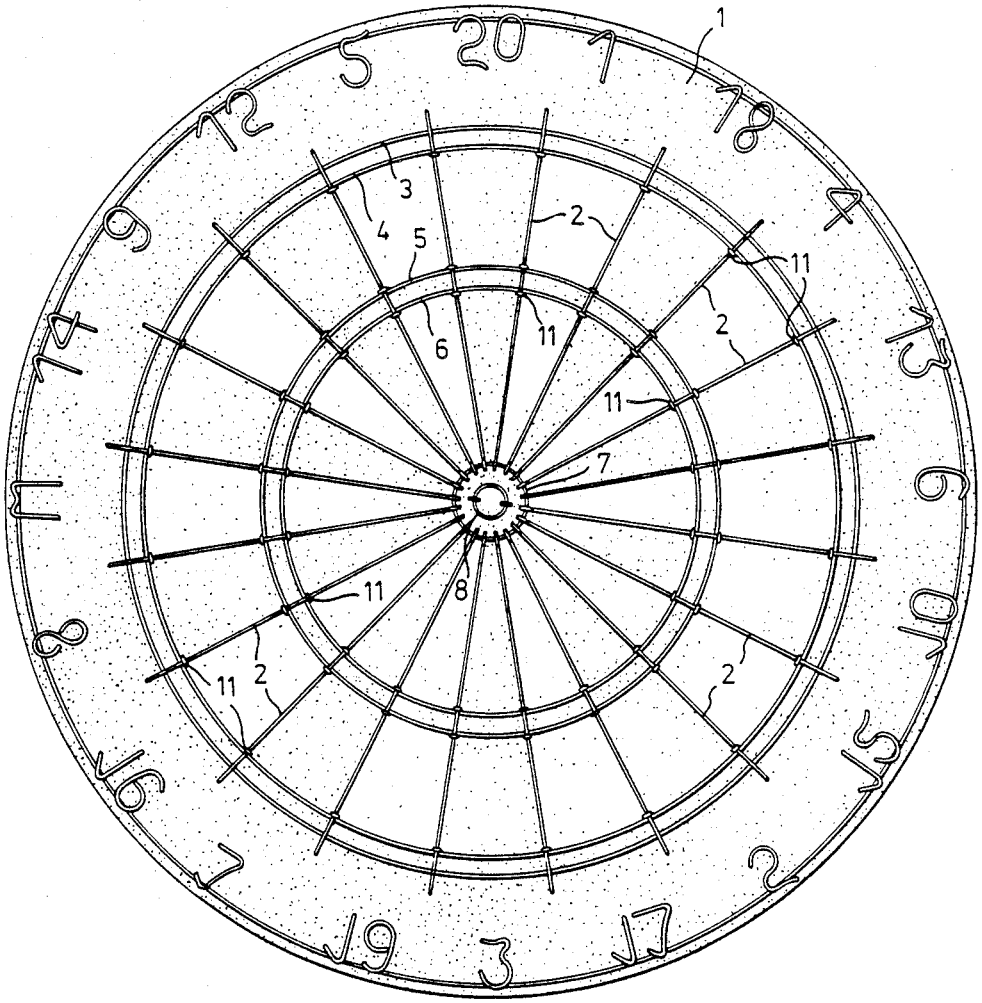
FIG. 1 is a plan view of a conventional dartboard.

Visually, a dartboard embodying the invention would be much the same as in FIGS. 1 and 2, namely, compressed sisal fibers making up a round playing boards 1, radially extending wires 2 defining sector-shaped playing areas and circular wires 3, 4, 5, 6, 7, and 8. The wires 3, 4 define an annulus which intersects the radial wires and is known as the doubles ring. Wires 7 and 8 together define a ring known as the outer bull and the area within the wire 8 is known as the inner bull. Where necessary, the wires are held to the board material by staples 11.

The radial wires 2 and at least some of the circular wires 3 to 8, preferably all except perhaps the wires 7 and 8, are of quadrilateral cross-section, such as square or the rhomboidal cross-section shown for the wires 3A, 4A, 5A and 6A in FIG. 3. The quadrilateral wires are arranged so that one corner is adjacent to the sisal material and the opposite corner is exposed to oncoming darts 12. This arrangement and construction allows the points of any darts happening to strike the wires to slide off the sides of the quadrilaterals into the sisal board instead of bouncing off and falling on the floor. Best results are obtained with hard drawn stainless steel wire or high tensile carbon steel and the preferred cross-section is about 1.25 mm square. The advantage of stainless steel is that it can be spot welded, whereby the number of staples can be minimised or staples can even be omitted altogether. It should also be mentioned that the use of quadrilateral wire simplifies production because it is much easier to handle by machine.

The conventional way of fixing the wires to the sisal material is by means of staples 11 as already mentioned. In addition, the conventional radial wires 2 are of U shape of which the end limbs constitute spikes for embedding in the sisal. Where the radial wires 2 intersect the circular wires 3, 4, 5, 6, and 7, they have to be crimped so that they will stand away from the sisal only at the places where they overlie the circular wires.

In the embodiment of the invention shown in FIG. 3, such crimping is dispensed with because, at the intersections with the circular wires 3A, 4A, 5A and 6A, the radial wires 2A are notched underneath at the positions where they cross-over the circular wires so that they may lie closer to the board. These notches are shown at 10 in FIG. 3, which also shows that the radial wires 2A can still be U-shaped so that the spikes or prongs 13, 14 at the ends can be embedded in the sisal. At the intersection between the radial wires 2A and the innermost circular wire 8, whether the latter be round or quadrilateral, the radial wire is, exceptionally, preferably looped rather than notched so as to avoid weakening near the prong 13. Accordingly, it may be preferred to hold the radial wire down to the sisal board by means of a staple near the prong 13. Intermediate the prongs, however, the radial wires are strong enough for notching by reason of their quadrilateral cross-section and, in the absence of crimping, staples should also be superfluous.

It is also possible, in a modification of the embodiment of FIG. 3, to notch the circular wires 3A, 4A, 5A and 6A, as indicated at 15, on the edges which are in contact with the radial wires 2A at the cross-over points with the radial wires 2A. By such a modification, it is possible for the radial wires to be brought even closer to the surface of the board.

In a further modification, only the upper edges of the circular wires 3A, 4A, 5A and 6A are notched, as indicated at 15, at the cross-over points.

It will be appreciated that, although the invention has been described, by way of example, with reference to particular embodiments, variations and modifications can be made.

For example, the radial and circular wires need not both be of the same cross section, and the wires need not have cross-sections which are quadrilateral in shape. The sides of the wires which face away from the board, although providing a cross-section which is tapered towards the edge of the wire remote from the board, may have faces in more than one plane. Thus one of the sides of a tapered portion may be made up of two longitudinally extending faces which are at an angle to one another. Such a wire may be considered to have more than four sides. It is also possible for the part of the wire, which is adjacent to or even embedded into the board, to have a different profile from that facing away from the board. Thus the profile of the wire which is nearest to the board may be rounded or even flat, as proposed in UK patent specification 406 400, provided that the wire has a strength that enables the required cross-section to be achieved and nicks to be formed where cross-overs occur.

The staples 11 may be made from wire which has a profile such that the sides of the wire which face outwards provide a tapered cross-section, similar to that of the radial and circular bed-defining wires.

We claim:

1. A dartboard of compressed sisal fibers having beds on a face of the board defined by wire, said wire having a quadrilateral cross-section, one corner of the wire being in contact with the board face, the opposite corner being exposed to the oncoming darts and the remaining two corners of the wire being spaced away from the board face, the wire being arranged to extend both radially and in a circle on the face, wherein a radially extending wire has sides that define a cross-section which is at least in part tapered, the radially extending wire being arranged on the board with the sides which define the tapered cross-section facing away from the board, and wherein a radially extending wire and a circularly extending wire cross over one another on the face, there being provided a notch in the part of either a radially extending or a circularly extending wire which is adjacent to the other at the cross-over point, or notches in the parts of each of the radially extending and the circularly extending wires which are adjacent to the other at the cross-over point.

2. A dartboard as claimed in claim 1 in which the radially extending and the circularly extending wires are welded together at the cross-over points.

3. A dartboard as claimed in claim 2 in which the radially extending wires overlie the circularly extending wires.

4. A dartboard as claimed in claim 2 wherein the wire is of high tensile carbon steel.

5. A dartboard of compressed sisal fibers having beds defined by radial and circular wires, the radial and at least part of the circular bed-defining wires being of quadrilateral cross-section with one of the corners being in contact with the sisal fibers, the opposite corner being exposed to oncoming darts, and the remaining two corners being spaced from the fibers and wherein the radial wires are notched at positions where they intersect the circular wires of quadrilateral cross-section whereby to form emplacements for the said circular wires of quadrilateral cross-section.

* * * * *